US010061227B2

(12) United States Patent
Funada

(10) Patent No.: US 10,061,227 B2
(45) Date of Patent: Aug. 28, 2018

(54) POWDER CONTAINER, DEVELOPING UNIT, AND IMAGE FORMING APPARATUS

(71) Applicant: FUJI XEROX CO., LTD., Tokyo (JP)

(72) Inventor: Atsushi Funada, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 3 days.

(21) Appl. No.: 15/446,254

(22) Filed: Mar. 1, 2017

(65) Prior Publication Data

US 2018/0074436 A1 Mar. 15, 2018

(30) Foreign Application Priority Data

Sep. 14, 2016 (JP) ..... 2016-179473

(51) Int. Cl.
*G03G 15/08* (2006.01)

(52) U.S. Cl.
CPC ..... *G03G 15/0865* (2013.01)

(58) Field of Classification Search
USPC ..... 399/106, 107, 110, 111, 113, 116, 119, 399/252, 254, 258, 262
See application file for complete search history.

(56) References Cited

U.S. PATENT DOCUMENTS

| | | | | |
|---|---|---|---|---|
| 7,587,155 | B2 * | 9/2009 | Suzuki | G03G 15/0868 399/113 |
| 7,747,199 | B2 * | 6/2010 | Koido | G03G 15/0855 399/262 |
| 8,190,066 | B2 * | 5/2012 | Sakuma | G03G 15/0868 399/106 |
| 2008/0219699 | A1 | 9/2008 | Kimura et al. | |

FOREIGN PATENT DOCUMENTS

| | | | |
|---|---|---|---|
| JP | 11-212349 | A | 8/1999 |
| JP | 2002-091150 | A | 3/2002 |
| JP | 2008-224777 | A | 9/2008 |

* cited by examiner

*Primary Examiner* — Hoan Tran
(74) *Attorney, Agent, or Firm* — Sughrue Mion, PLLC

(57) ABSTRACT

A powder container includes a storing chamber that stores powder, a discharge path extending through a wall of the storing chamber and from which the powder is discharged, an inner wall that forms an inner surface of the wall and has an opening communicating with the discharge path, an outer wall that forms an outer surface of the wall and has an opening communicating with the discharge path, and an opening-and-closing member provided between the inner wall and the outer wall and that opens and closes the discharge path while moving along the inner wall and the outer wall.

4 Claims, 10 Drawing Sheets

POWDER CONTAINER, DEVELOPING UNIT, AND IMAGE FORMING APPARATUS

CROSS-REFERENCE TO RELATED APPLICATIONS

This application is based on and claims priority under 35 USC 119 from Japanese Patent Application No. 2016-179473 filed Sep. 14, 2016.

BACKGROUND

(i) Technical Field

The present invention relates to a powder container, a developing unit, and an image forming apparatus.

(ii) Related Art

Hitherto known image forming apparatuses include those that form images by developing latent images with developing units. Exemplary developing units include those that contain powder developer. Such a developing unit is regarded as a kind of a powder container, as with a toner cartridge that stores toner particles or the like to be supplied to the developing unit, a storage box that stores unnecessary toner particles or the like collected in the image forming apparatus, and so forth.

SUMMARY

According to an aspect of the invention, there is provided a powder container including a storing chamber that stores powder, a discharge path extending through a wall of the storing chamber and from which the powder is discharged, an inner wall that forms an inner surface of the wall and has an opening communicating with the discharge path, an outer wall that forms an outer surface of the wall and has an opening communicating with the discharge path, and an opening-and-closing member provided between the inner wall and the outer wall and that opens and closes the discharge path while moving along the inner wall and the outer wall.

BRIEF DESCRIPTION OF THE DRAWINGS

An exemplary embodiment of the present invention will be described in detail based on the following figures, wherein.

DETAILED DESCRIPTION

Figure 1:
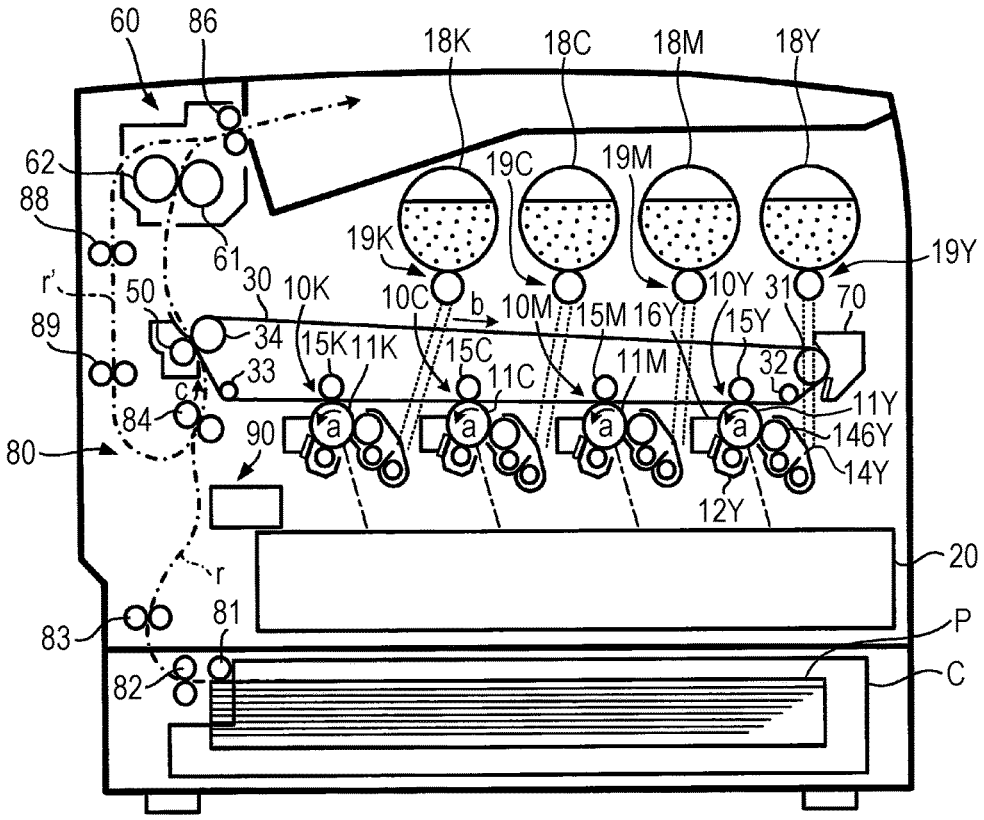
FIG. 1 is a diagram of an image forming apparatus according to the exemplary embodiment of the present invention.

FIG. 1 is a diagram of an image forming apparatus according to an exemplary embodiment of the present invention.

An image forming apparatus 1 illustrated in FIG. 1 is a tandem-type color printer in which image forming units 10Y, 10M, 10C, and 10K provided for different colors of yellow (Y), magenta (M), cyan (C), and black (K) are arranged in parallel and is capable of printing a full-color image composed of toner images in the four respective colors and a monochrome image in, for example, black (K).

The image forming apparatus 1 includes an exposure unit 20 that applies exposure beams to the image forming units 10Y, 10M, 10C, and 10K; an intermediate transfer belt 30 to which the toner images are transferred from the image forming units 10Y, 10M, 10C, and 10K; a second transfer unit 50 that transfers the toner images from the intermediate transfer belt 30 to a sheet P; a fixing device 60 that fixes the toner images on the sheet P; a belt cleaner 70 that collects toner particles from the intermediate transfer belt 30; a sheet transporting unit 80 that transports the sheet P; a controller 90 that controls operations of relevant elements of the image forming apparatus 1; a sheet tray C that contains sheets P; toner cartridges 18Y, 18M, 18C, and 18K that contain toner particles in the respective colors of Y, M, C, and K; and toner supplying devices 19Y, 19M, 19C, and 19K that supply the toner particles from the toner cartridges 18Y, 18M, 18C, and 18K to the image forming units 10Y, 10M, 10C, and 10K, respectively.

The four image forming units 10Y, 10M, 10C, and 10K all have substantially the same configuration. Therefore, the image forming unit 10Y for yellow will be described herein as a representative. The image forming unit 10Y includes a photoconductor 11Y, a charging unit 12Y, a developing unit 14Y, a first transfer unit 15Y, and a photoconductor cleaner 16Y. The photoconductor 11Y has a cylindrical shape. The photoconductor 11Y carries an image formed on a surface thereof and rotates about the axis of the cylindrical body thereof in a direction of arrow a. The photoconductor 11Y is an example of the image carrier according to the present invention, and so are the other photoconductors 11M, 11C, and 11K.

The charging unit 12Y includes a charging roller that rotates while being in contact with the photoconductor 11Y and thus charges the surface of the photoconductor 11Y.

The developing unit 14Y contains developer composed of toner particles and magnetic carrier particles. The developing unit 14Y includes a developing roller 146Y. The developing roller 146Y transports the developer to the photoconductor 11Y. When some toner particles of the developer adhere to the photoconductor 11Y, a toner image is formed on the photoconductor 11Y. The toner supplying device 19Y supplies fresh toner particles from the toner cartridge 18Y to the developing unit 14Y. The developing unit 14Y is an exemplary embodiment of the powder container according to the present invention and is also an exemplary embodiment of the developing unit according to the present invention.

The toner supplying device 19Y includes a toner transporting mechanism (not illustrated) that operates under the control of the controller 90.

The first transfer unit 15Y transfers the toner image on the photoconductor 11Y to the intermediate transfer belt 30. The photoconductor cleaner 16Y cleans the surface of the photoconductor 11Y that has undergone the transfer.

The exposure unit 20 emits exposure beams generated from image signals supplied from an external apparatus and exposes the photoconductors 11Y, 11M, 11C, and 11K to the respective exposure beams.

The intermediate transfer belt 30 is an endless belt-type member that is supported by belt supporting rollers 31, 32, 33, and 34 and rotates in a direction of arrow b along a circular path connecting the image forming units 10Y, 10M, 10C, and 10K and the second transfer unit 50. The intermediate transfer belt 30 carries the toner images in the respective colors that are formed by the image forming units 10Y, 10M, 10C, and 10K and are transferred thereto.

The second transfer unit 50 is a rotatable roller that operates in combination with a backup roller 34, which is one of the belt supporting rollers 31 to 34, such that the intermediate transfer belt 30 and a sheet P are nipped between the roller thereof and the backup roller 34. A voltage that generates an electric field for toner transfer is supplied to the nip between the second transfer unit 50 and the backup roller 34, whereby the toner images on the intermediate transfer belt 30 are transferred to the sheet P.

The belt cleaner 70 includes a blade. The blade is brought into contact with the intermediate transfer belt 30, whereby toner particles remaining on the intermediate transfer belt 30 are removed.

The fixing device 60 includes a heating roller 61 and a pressing roller 62. The sheet P having the toner images that are yet to be fixed is passed through the nip between the heating roller 61 and the pressing roller 62, whereby the toner images on the sheet P are fixed.

The sheet transporting unit 80 picks up one of the sheets P from the sheet tray C and transports the sheet P along a sheet transport path r passing through the second transfer unit 50 and the fixing device 60. The sheet transporting unit 80 includes a pickup roller 81 that picks up one of the sheets P contained in the sheet tray C, a pair of separating rollers 82 that separate the picked sheet P from the others, a pair of transport rollers 83 that transport the separated sheet P upward, a pair of registration rollers 84 that transport the sheet P to the second transfer unit 50, a pair of discharge rollers 86 that discharge the sheet P to the outside of the image forming apparatus 1, and pairs of reversing rollers 88 and 89 that transport the sheet P when duplex printing is performed.

A basic operation of the image forming apparatus 1 illustrated in FIG. 1 will now be described.

In the image forming unit 10Y for yellow, the photoconductor 11Y is rotated in the direction of arrow a, and an electrical charge is applied to the surface of the photoconductor 11Y by the charging unit 12Y. This also applies to the image forming units 10M, 10C, and 10K for the respective colors other than yellow. The exposure unit 20 applies exposure beams generated from pieces of data composing image signals for the respective colors to the photoconductors 11Y, 11M, 11C, and 11K. Herein, a representative operation for yellow (Y) will be described. The exposure unit 20 applies to the surface of the photoconductor 11Y an exposure beam generated from an image signal for yellow that is supplied from an external apparatus, thereby forming an electrostatic latent image on the surface of the photoconductor 11Y. The developing unit 14Y develops the electrostatic latent image with developer containing yellow toner particles, thereby forming a toner image. The developing unit 14Y is supplied with toner particles from the toner cartridge 18Y by the toner supplying device 19Y. The photoconductor 11Y rotates while carrying the yellow toner image formed thereon. The toner image on the surface of the photoconductor 11Y is then transferred to the intermediate transfer belt 30 by the first transfer unit 15Y that applies a transfer potential to the nip between the photoconductor 11Y and the intermediate transfer belt 30. After the transfer, toner particles remaining on the photoconductor 11Y are collected by the photoconductor cleaner 16Y and are removed from the photoconductor 11Y.

As with the image forming unit 10Y for yellow, the image forming units 10M, 10C, and 10K for the colors other than yellow also form toner images in the respective colors. The first transfer units 15M, 15C, and 15K transfer the respective toner images to the intermediate transfer belt 30 such that the toner images are sequentially superposed on the yellow toner image. The toner images on the intermediate transfer belt 30 move toward the second transfer unit 50 with the rotation of the intermediate transfer belt 30.

Meanwhile, one of the sheets P in the sheet tray C is picked up by the pickup roller 81 and is transported in a direction of arrow c toward the second transfer unit 50 along the sheet transport path r by the pair of separating rollers 82, the pair of transport rollers 83, and the pair of registration rollers 84. Synchronously with the toner images on the intermediate transfer belt 30 reaching the second transfer unit 50, the sheet P is fed to the second transfer unit 50 by the pair of registration rollers 84.

The second transfer unit 50 applies a transfer bias potential to the nip between the intermediate transfer belt 30 and the sheet P, thereby transferring the toner images on the intermediate transfer belt 30 to the sheet P. Toner particles remaining on the intermediate transfer belt 30 after the transfer performed by the second transfer unit 50 are removed by the belt cleaner 70.

The sheet P now having the toner images transferred thereto by the second transfer unit 50 is transported to the fixing device 60, where the toner images on the sheet P are fixed. Thus, a finished image is formed on the sheet P. The sheet P having the finished image is discharged to the outside of the image forming apparatus 1 by the pair of discharge rollers 86 and is stacked at the top of the image forming apparatus 1.

In duplex printing in which another image is formed on the back side of the sheet P already having an image on the front side thereof, the sheet P is discharged halfway from the discharge port by the pair of discharge rollers 86 and is then transported in the reverse direction. The sheet P transported in the reverse direction is transported by the pairs of reversing rollers 88 and 89 along a reverse transport path r' toward the upstream side of the pair of registration rollers 84. The sheet P thus transported is turned upside down before reaching the pair of registration rollers 84, and is fed from the pair of registration rollers 84 to the second transfer unit 50 again, where another image is formed on the back side of the sheet P.

Now, the developing unit 14 will be described in detail.

The image forming apparatus 1 illustrated in FIG. 1 includes four developing units 14Y, 14M, 14C, and 14K, which all have substantially the same configuration. Therefore, in the following description, the suffixes Y, M, C, and K representing the toner colors are omitted, and the developing units are each denoted simply by reference numeral 14. The omission of the suffixes also applies to elements included in each developing unit 14 and to the elements other than the developing unit 14 that will be described with reference to FIG. 1.

Figure 2:
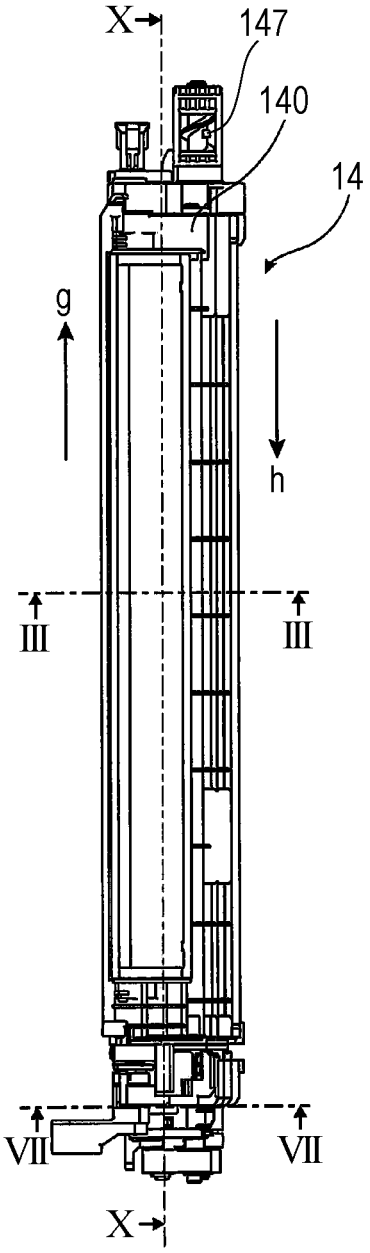
FIG. 2 is a plan view of a developing unit.

FIG. 2 is a plan view of the developing unit 14.

FIG. 2 illustrates the upper side of the developing unit 14. The developing unit 14 includes a housing 140. The housing 140 has a toner supply port 147 that is open upward. The housing 140 of the developing unit 14 also has a developer discharge port that is open downward and is therefore hidden in FIG. 2. The toner supply port 147 and the developer discharge port will be described later.

Figure 3:
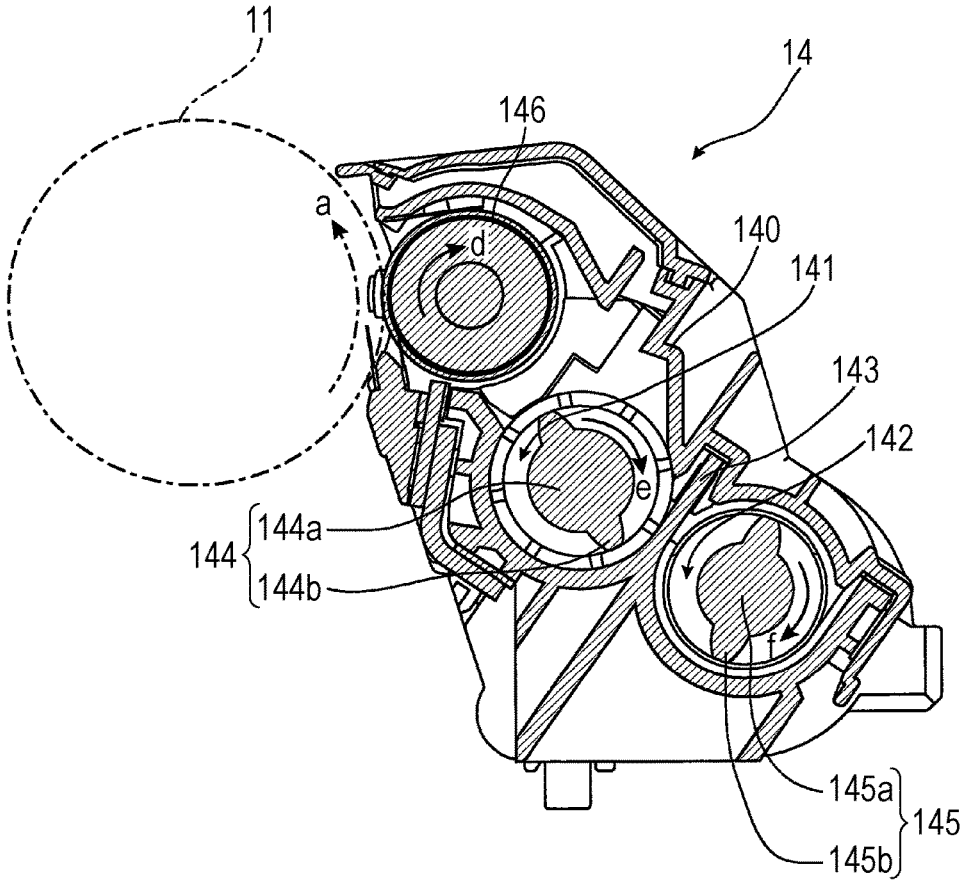
FIG. 3 is a sectional view of the developing unit that is taken along line III-III illustrated in FIG. 2.

FIG. 3 is a sectional view of the developing unit 14 that is taken along line III-III illustrated in FIG. 2.

The developing unit 14 has a storing chamber in the housing 140. The storing chamber is sectioned into a first chamber 141 and a second chamber 142 in each of which developer is stored. The first chamber 141 and the second chamber 142 of the storing chamber are separated from each other by a partition 143. The first chamber 141 is provided with a supply auger 144. The second chamber 142 is provided with an admixing auger 145. The supply auger 144 and the admixing auger 145 each have a bar-like shape and extend horizontally and parallel to each other. The supply auger 144 includes a rotating shaft 144*a* having a round sectional shape, and a helical blade 144*b* helically wound around the rotating shaft 144*a*. Likewise, the admixing auger 145 includes a rotating shaft 145*a* having a round sectional shape, and a helical blade 145*b* helically wound around the rotating shaft 145*a*. The supply auger 144 and the admixing auger 145 each include another helical blade separately from the helical blade 144*b* or 145*b* illustrated in FIG. 3. Description of the other helical blade is omitted herein.

The supply auger 144 and the admixing auger 145 rotate in the same direction as represented by respective arrows e and f illustrated in FIG. 3. The helical blade 144*b* of the supply auger 144 and the helical blade 145*b* of the admixing auger 145 are helixes that are wound in opposite directions. When the supply auger 144 and the admixing auger 145 rotate in the same direction represented by arrows e and f illustrated in FIG. 3, the developer in the first chamber 141 and in the second chamber 142 is stirred and is transported in opposite directions. Specifically, the developer in the first chamber 141 provided with the supply auger 144 is transported in a direction of arrow g illustrated in FIG. 2 with the rotation of the supply auger 144 in the direction of arrow e, whereas the developer in the second chamber 142 provided with the admixing auger 145 is transported in a direction of arrow h illustrated in FIG. 2 with the rotation of the admixing auger 145 in the direction of arrow f.

The partition 143 that separates the first chamber 141 and the second chamber 142 from each other has two windows (not illustrated) at two respective ends thereof. The windows each connect the first chamber 141 and the second chamber 142 to each other. Hence, the developer transported in the direction of arrow g in the first chamber 141 passes through one of the windows and flows into the second chamber 142, whereas the developer transported in the direction of arrow h in the second chamber 142 passes through the other window and flows into the first chamber 141. Thus, the developer in the developing unit 14 circulates between the first chamber 141 and the second chamber 142.

The developing unit 14 includes the developing roller 146 near the first chamber 141 provided with the supply auger 144. A part of the developing roller 146 is exposed to the outside from the housing 140. The developing unit 14 is positioned in the image forming apparatus 1 (see FIG. 1) such that the exposed part of the developing roller 146 is in proximity to the photoconductor 11.

The developing roller 146 magnetically attracts the developer in the first chamber 141 to the surface thereof and transports, while rotating in a direction of arrow d, the developer to a position facing the photoconductor 11. Then, the electrostatic latent image formed on the surface of the photoconductor 11 is developed with toner particles contained in the developer, whereby a toner image is formed on the surface of the photoconductor 11. Meanwhile, the developer remaining on the developing roller 146 after the development with toner particles returns to the inside of the housing 140 with the rotation of the developing roller 146, drops from the developing roller 146, and is mixed with the rest of the developer in the first chamber 141. Then, the mixture is stirred while circulating in the developing unit 14.

As the above development with toner particles is performed repeatedly, the amount of toner particles in the developer stored in the developing unit 14 is reduced. Hence, the developing unit 14 has the toner supply port 147 (see FIG. 2) that receives the supply of toner particles. Toner particles in the toner cartridge 18 illustrated in FIG. 1 are supplied into the developing unit 14 by the toner supplying device 19. The toner supply port 147 is provided at a position of the second chamber 142, provided with the admixing auger 145, on the upstream side (a side opposite the side toward which arrow h is headed) with respect to the window through which the developer in the first chamber 141 flows into the second chamber 142. The admixing auger 145 extends up to the position of the toner supply port 147. Toner particles supplied from the toner supply port 147 are transported toward the downstream side (in the direction of arrow h) in the second chamber 142 and is mixed with the developer flowing into the second chamber 142 through the window provided in the partition 143. Then, the mixture is further transported toward the downstream side (in the direction of arrow h) in the second chamber 142.

Figure 4A:
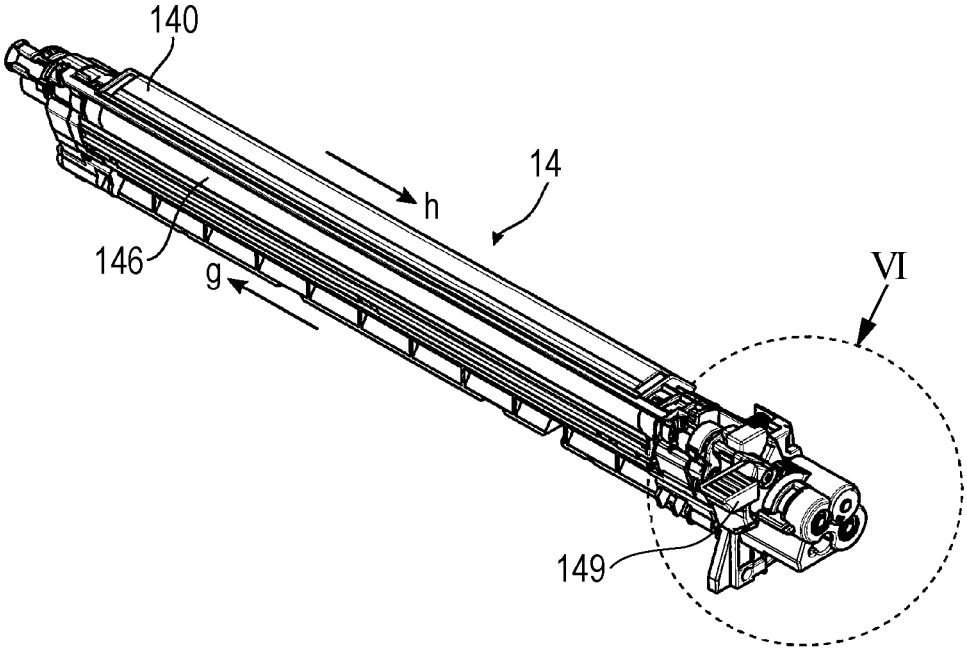
FIGS. 4A and 4B are perspective views of the developing unit.
Figure 4B:
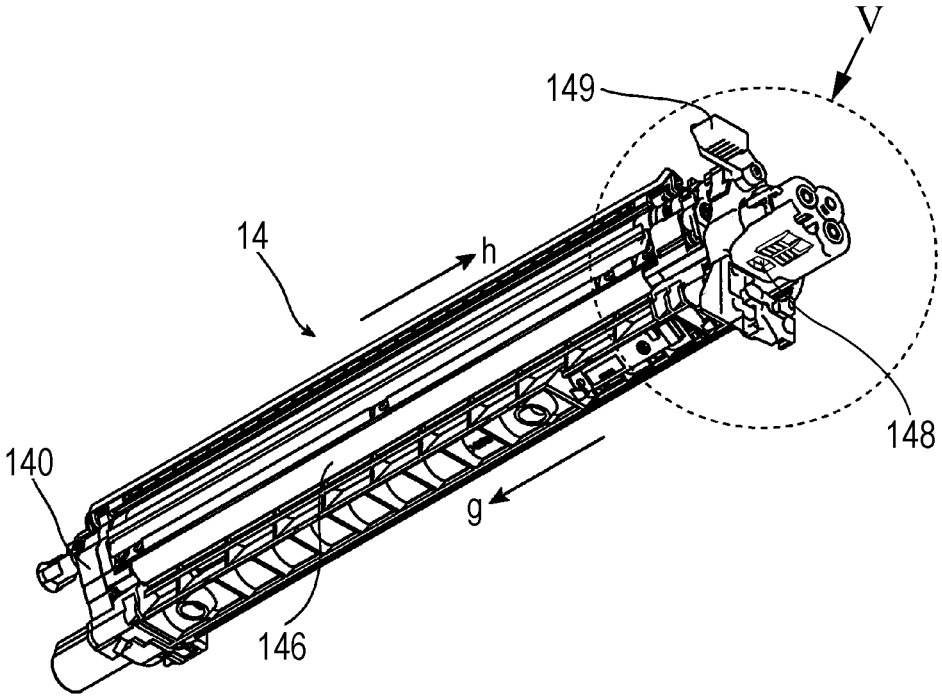

FIG. 4A is a top perspective view of the developing unit 14. FIG. 4B is a bottom perspective view of the developing unit 14.

Figure 5:
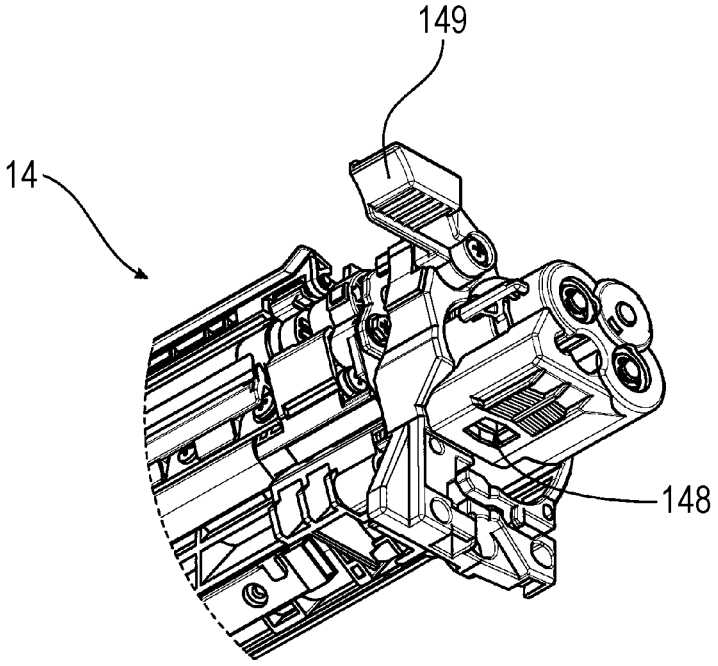
FIG. 5 is an enlargement of a part of the developing unit that is defined by circle V illustrated in FIG. 4B.

FIG. 5 is an enlargement of a part of the developing unit 14 that is defined by circle V in FIG. 4B.

FIGS. 4B and 5 illustrate a developer discharge port 148. The developer discharge port 148 is an opening provided in the lower surface of the housing 140 of the developing unit 14 and facing downward. The developer discharge port 148 is provided at the most upstream position (an extreme end in the direction opposite to the direction of arrow g illustrated in FIG. 2), in the developer transporting direction, of the first chamber 141 provided with the supply auger 144. Specifically, the developer transported in the direction of arrow h illustrated in FIG. 2 in the second chamber 142 provided with the admixing auger 145 passes through the window provided in the partition 143 and flows into the first chamber 141, and the developer discharge port 148 is provided on the upstream side with respect to the window in the developer transporting direction (the direction of arrow g illustrated in FIG. 2).

The supply auger 144 provided in the first chamber 141 is provided with not only the helical blade 144*b* that transports the developer having flowed into the first chamber 141 in the developer transporting direction (the direction of arrow g illustrated in FIG. 2) but also a helical blade 144*c* (see FIG. 10) that is wound in a direction opposite to the direction in which the helical blade 144*b* is wound. The helical blade 144*c* is provided on the upstream side (a side opposite the side toward which arrow g illustrated in FIG. 2 is headed) with respect to a position near the window through which the developer flows into the first chamber 141.

Hence, some of the developer having flowed into the first chamber 141 is pushed toward the upstream side in the direction opposite to the direction of arrow g by the reversely wound helical blade 144*c* and is discharged to the outside of the developing unit 14 from the developer discharge port 148. The first chamber 141 is an example of the storing chamber according to the present invention, and the developer discharge port 148 is an example of the discharge path according to the present invention.

The developer in the developing unit 14 is discharged from the developer discharge port 148 little by little, whereby the excessive progress in the deterioration of the developer in the developing unit 14 due to stirring and transporting is suppressed. When the developer is discharged from the developer discharge port 148, both toner particles and carrier particles are discharged. Hence, toner particles supplied from the toner supply port 147, i.e., toner particles in the toner cartridge 18 (see FIG. 1) contain a small amount of carrier particles that compensates for the reduction in the carrier particles.

The developing unit 14 is detachably attached to the body of the image forming apparatus 1 illustrated in FIG. 1. Therefore, the developing unit 14 is provided with a shutter member 200 (see FIGS. 7 and 11) that openably closes the developer discharge port 148 so that the developer does not spill from the developer discharge port 148 when the developing unit 14 is detached from the image forming apparatus 1. To detach the developing unit 14 from the image forming apparatus 1, an operation of closing the shutter member 200 to close the developer discharge port 148 is performed. Furthermore, an operation lever 149 that is oriented horizontally as illustrated in FIGS. 4A and 4B is turned by 90 degrees in such a manner as to be oriented vertically. When the operation lever 149 is oriented vertically, the developing unit 14 slightly moves away from the photoconductor 11 (see FIGS. 1 and 3). Thus, when the developer discharge port 148 is closed by the shutter member 200 and the operation lever 149 is turned to be oriented vertically, the developing unit 14 moves away from the photoconductor 11 and is allowed to be pulled out in the direction of arrow h illustrated in FIGS. 4A and 4B. Then, the developing unit 14 is detached from the image forming apparatus 1.

To attach the developing unit 14 to the image forming apparatus 1, the above operation is performed reversely. Specifically, with the operation lever 149 oriented vertically, the developing unit 14 is inserted into the body of the image forming apparatus 1 in the direction of arrow g illustrated in FIGS. 4A and 4B. Then, the operation lever 149 is turned to be oriented horizontally as illustrated in FIGS. 4A and 4B. Furthermore, an operation of opening the shutter member 200 that is still closing the developer discharge port 148 is performed. The operation of opening or closing the shutter member 200 will be described later.

Figure 6A:
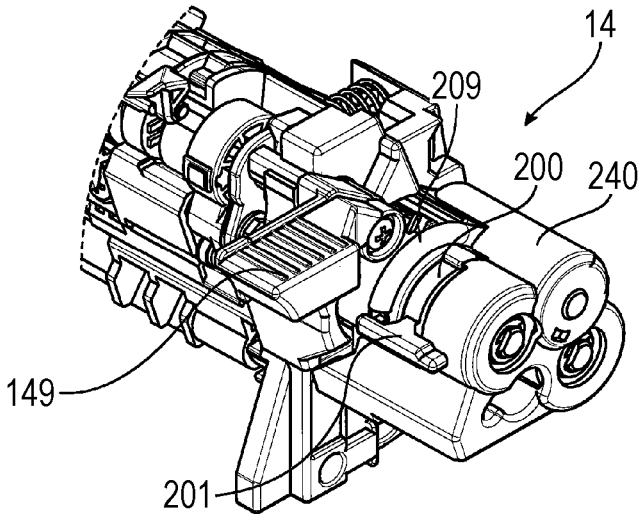
FIGS. 6A and 6B are enlarged perspective views of a part of the developing unit that is defined by circle VI illustrated in FIG. 4A.
Figure 6B:
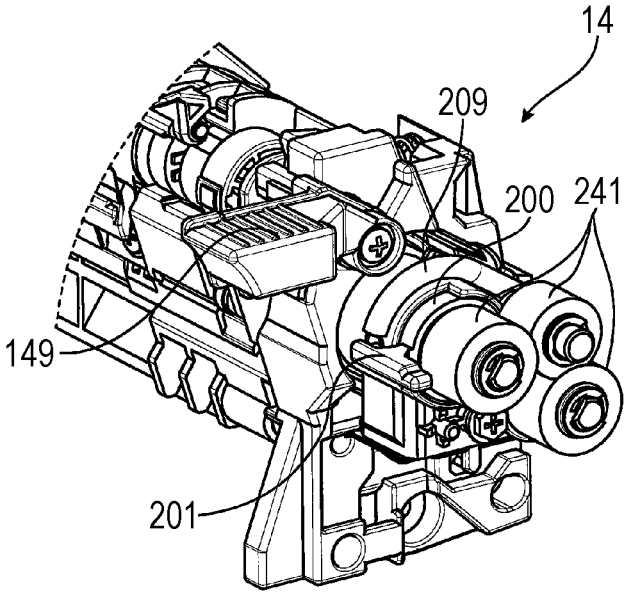

FIGS. 6A and 6B are enlarged perspective views of a part of the developing unit 14 that is defined by circle VI in FIG. 4A. FIG. 6A is a simple enlargement of the part defined by circle VI. FIG. 6B illustrates the same part, with a gear covering 240 that is illustrated in FIGS. 4A and 6A removed so that gears 241 that are covered by the gear covering 240 are exposed.

FIGS. 6A and 6B illustrate a part of the shutter member 200 closing the developer discharge port 148 (see FIGS. 4A and 4B) that appears on the outer surface of the developing unit 14.

The shutter member 200 is a substantially cylindrical member provided at the most upstream end of the first chamber 141 (see FIG. 3) in the developer transporting direction (the direction of arrow g illustrated in FIG. 2). The part of the first chamber 141 where the shutter member 200 is provided has a double-wall structure including an inner wall and an outer wall each having a substantially cylindrical shape. The shutter member 200 is held between the inner wall and the outer wall. The shutter member 200 slidably rotates about the axis of rotation of the supply auger 144 while being in contact with the inner wall and with the outer wall, thereby opening and closing the developer discharge port 148.

The shutter member 200 includes an opening-and-closing lever 201 illustrated in FIGS. 6A and 6B. A spring member 209 is connected to the opening-and-closing lever 201. The opening-and-closing lever 201 illustrated in FIGS. 6A and 6B is in a state of being pressed downward by a member (not illustrated) included in a collecting box 301 (see FIGS. 12 and 13). In this state, the spring member 209 is in an expanded state, and the shutter member 200 is oriented in such a manner as to open the developer discharge port 148. The above-mentioned operation of closing the shutter member 200 is performed as follows. The downward pressing force applied to the opening-and-closing lever 201 by the member of the collecting box 301 is reduced, whereby the opening-and-closing lever 201 is released from the member.

When the opening-and-closing lever 201 is released, the spring member 209 contracts, whereby the shutter member 200 rotates in such a manner as to close the developer discharge port 148. That is, when the developing unit 14 is out of the image forming apparatus 1, the opening-and-closing lever 201 of the shutter member 200 is free from the force exerted by the member of the collecting box 301. Accordingly, the shutter member 200 is kept in an orientation for closing the developer discharge port 148 while receiving the urging force exerted by the spring member 209. In contrast, when the developing unit 14 is attached to the image forming apparatus 1 and the operation of opening the developer discharge port 148 is performed, the member of the collecting box 301 turns the opening-and-closing lever 201 against the urging force of the spring member 209 and keeps pressing down the opening-and-closing lever 201. Thus, the shutter member 200 is retained in the orientation in which the developer discharge port 148 is kept open.

The gears 241 illustrated in FIG. 6B rotate by receiving a rotational driving force from a drive source (not illustrated), thereby rotating the supply auger 144 and the admixing auger 145.

Figure 7:
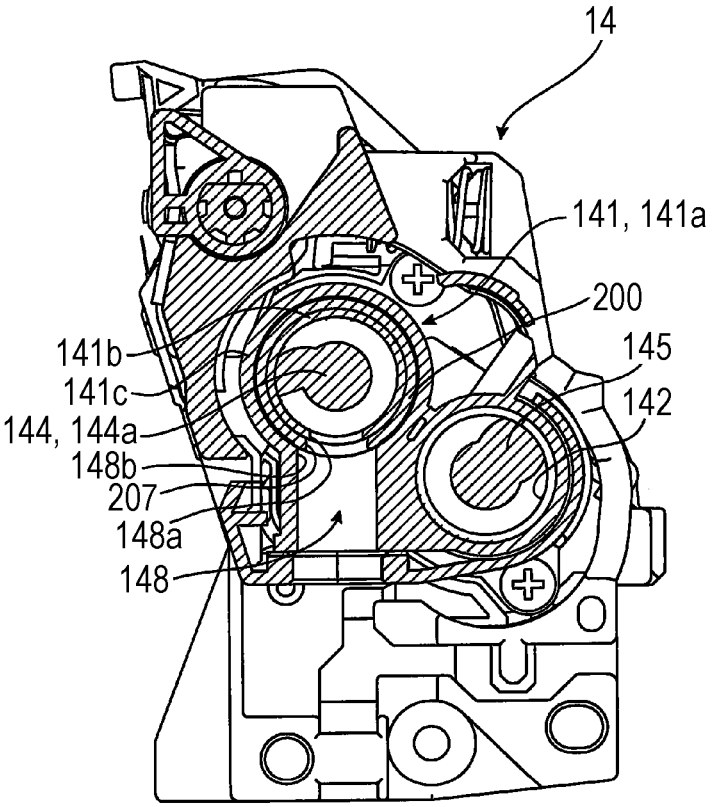
FIG. 7 is a sectional view of the developing unit that is taken along line VII-VII illustrated in FIG. 2.

FIG. 7 is a sectional view of the developing unit 14 that is taken along line VII-VII illustrated in FIG. 2.

FIG. 7 illustrates the developer discharge port 148 and the shutter member 200. The developer discharge port 148 is provided at a most upstream part 141*a* (see FIG. 11 also) of the first chamber 141 in the housing 140 of the developing unit 14. The shutter member 200 is provided at the most upstream part 141*a* of the first chamber 141. As illustrated in FIG. 7, the most upstream part 141*a* of the first chamber 141 where the developer discharge port 148 and the shutter member 200 are provided has an inner wall 141*b* and an outer wall 141*c* each having a circular sectional shape. The inner wall 141*b* and the outer wall 141*c* are an example of the inner wall and an example of the outer wall, respectively, according to the present invention.

The shutter member 200 that is held between the inner wall 141*b* and the outer wall 141*c* has an outer wall surface and an inner wall surface each having a circular sectional shape. When the shutter member 200 opens or closes the developer discharge port 148, the shutter member 200 rotates coaxially with the rotating shaft 144*a* of the supply auger 144 while sliding along the inner wall 141*b* and the outer wall 141*c*. The shutter member 200 is an example of the opening-and-closing member according to the present invention.

The shutter member 200 illustrated in FIG. 7 is in an "open orientation" in which the developer discharge port 148 is open. The developer discharge port 148 extends from an inner-wall opening 148*a* provided in the inner wall 141*b* to an outer-wall opening 148*b* provided in the outer wall 141*c*. The shutter member 200 has a shutter opening 207. When the shutter member 200 is in the open orientation as illustrated in FIG. 7, the shutter opening 207 communicates with the inner-wall opening 148*a* and the outer-wall opening 148*b*. The shutter opening 207 is narrower than the outer-wall opening 148*b*. Hence, when the shutter member 200 that is in the open orientation as illustrated in FIG. 7 is seen in the direction in which the developer passes through the developer discharge port 148, the edges of the shutter opening 207 and the outer-wall opening 148*b* do not coincide with each other. The shutter opening 207 is wider than the inner-wall opening 148*a*. Hence, when the shutter member 200 that is in the open orientation as illustrated in FIG. 7 is seen in the direction in which the developer passes through the developer discharge port 148, the edges of the shutter opening 207 and the inner-wall opening 148*a* do not coincide with each other. In other words, when seen in the direction in which the developer passes through the developer discharge port 148, the shutter opening 207 is positioned on the inner side of the outer-wall opening 148*b*, and the inner-wall opening 148*a* is positioned on the inner side of the shutter opening 207.

Figure 13:
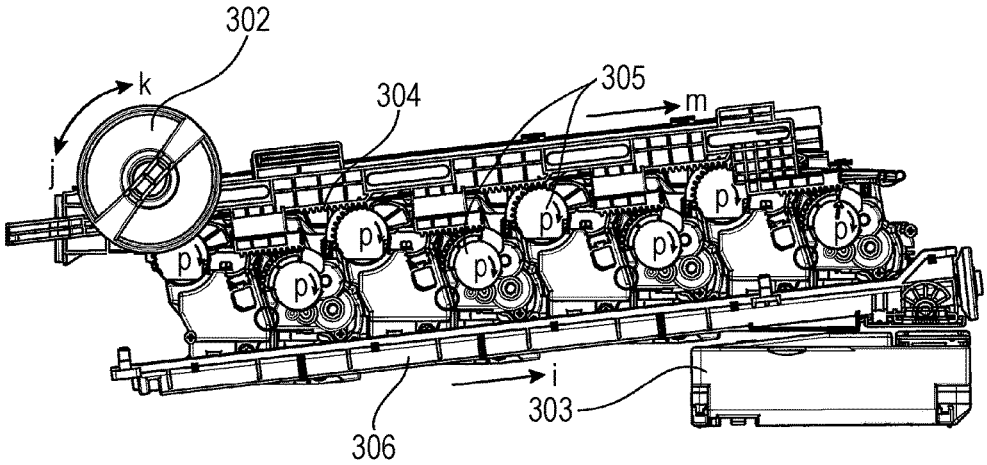
FIG. 13 illustrates an internal configuration of the collecting box.

Therefore, the developer that passes through the developer discharge port 148 drops down into the developer discharge port 148 almost without smudging the edges of the shutter opening 207 and the outer-wall opening 148*b*. The developer thus dropped down is transported through a waste-toner-transporting tube 306 in a direction of arrow i, as illustrated in FIG. 13, and is stored in a waste-toner tank 303.

Furthermore, the configuration in which the shutter member 200 is held between the inner wall 141*b* and the outer wall 141*c* prevents the developer from spilling when the shutter member 200 is in a "closed orientation" in which the developer discharge port 148 is closed by the shutter member 200.

Figure 8:
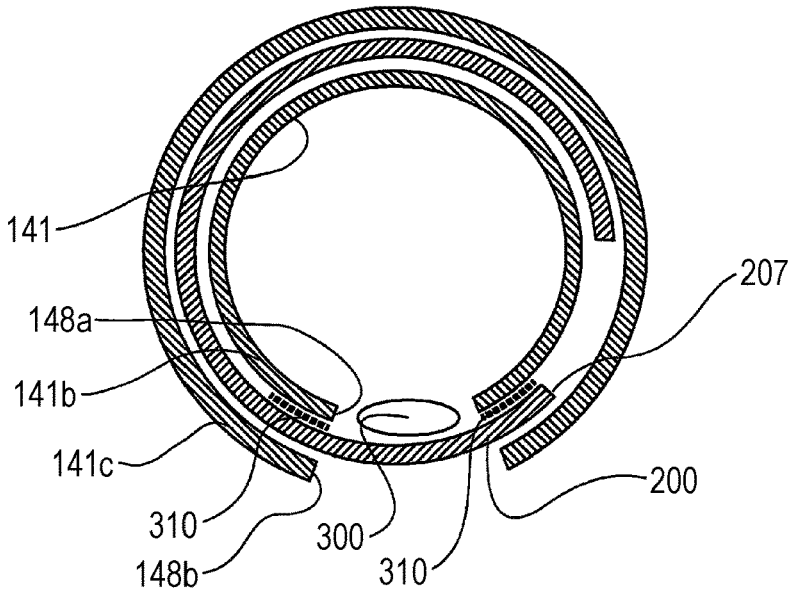
FIG. 8 is a conceptual diagram illustrating a mechanism of preventing the spilling of developer.

FIG. 8 is a conceptual diagram illustrating the mechanism of preventing the spilling of the developer.

When the shutter member 200 is in the "closed orientation," some developer 300 in the first chamber 141 may pass through the inner-wall opening 148*a* of the inner wall 141*b* and drop onto the inner surface of the shutter member 200. Such developer 300 dropped onto the inner surface of the shutter member 200 stays as smudge 310 at the gap between the shutter member 200 and the inner wall 141*b* with repeated rotation of the shutter member 200 between the "closed orientation" and the "open orientation." However, the smudge 310 scarcely passes through the shutter opening 207 of the shutter member 200 and reaches the outer wall 141*c*. Hence, the outer surface of the shutter member 200 is kept clean. Consequently, the spilling of the developer from the outer-wall opening 148*b* to the outside that may occur at the attaching or detaching of the developing unit 14 is prevented.

Moreover, the shutter member 200 according to the exemplary embodiment is made of a magnetic material, that is, the shutter member 200 is a magnet. Hence, the developer 300 forms bristles with the magnetic force exerted by the magnet. Thus, the developer 300 is prevented from entering the gap between the shutter member 200 and the inner wall 141*b*. Therefore, the amount of smudge 310 is small, and the spilling of the developer is more assuredly prevented. The shutter member 200 according to the exemplary embodiment functions as an example of the blocking member according to the present invention. Other examples of the blocking member according to the present invention include a seal member that physically seals the gap between the shutter member 200 and the inner wall 141*b*.

Figure 9:
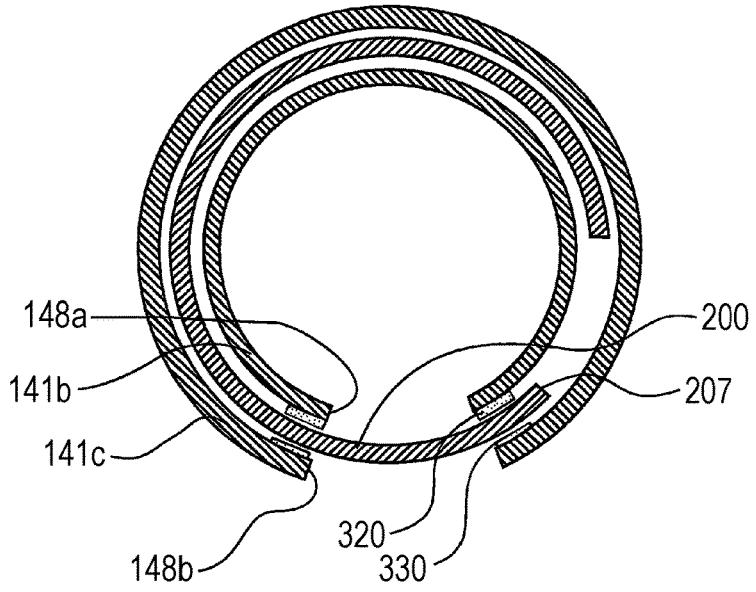
FIG. 9 is a conceptual diagram illustrating seal members as exemplary blocking members.

FIG. 9 is a conceptual diagram illustrating seal members each functioning as another example of the blocking member.

FIG. 9 illustrates an inner-wall seal member 320 fixed to the edge of the inner-wall opening 148*a*, and an outer-wall seal member 330 fixed to the edge of the outer-wall opening 148*b*. The inner-wall seal member 320 seals the gap between the inner surface of the shutter member 200 and the inner wall 141*b*, thereby basically blocking the entry of developer dropped onto the inner surface of the shutter member 200 that is in the "closed orientation." The inner-wall seal member 320 is an example of the blocking member according to the present invention. The outer-wall seal member 330 seals the gap between the outer surface of the shutter member 200 and the outer wall 141*c*, thereby basically blocking the entry of developer, if any, adhered to the edge of the shutter opening 207 of the shutter member 200 that is in the "open orientation."

The provision of the inner-wall seal member 320 and the outer-wall seal member 330 more assuredly prevents the spilling of the developer.

Figure 10:
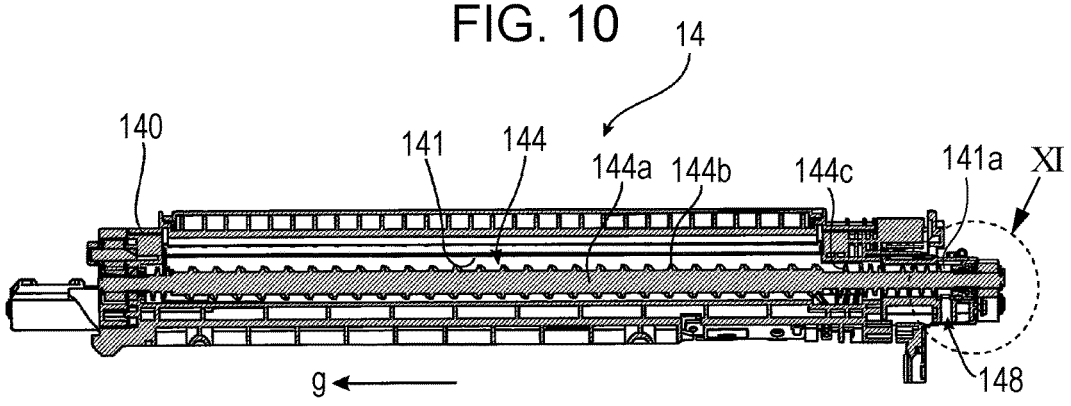
FIG. 10 is a sectional view of the developing unit that is taken along line X-X illustrated in FIG. 2.

FIG. 10 is a sectional view of the developing unit 14 that is taken along line X-X illustrated in FIG. 2.

FIG. 10 illustrates the entirety of the supply auger 144. The developer in the second chamber 142 (see FIG. 3) flows into the first chamber 141, in which the supply auger 144 is provided, through the window (not illustrated) of the partition 143 that is provided near the helical blade 144*c* of the supply auger 144. The helical blade 144*c* is wound in the direction opposite to the direction in which the helical blade 144*b* is wound. The helical blade 144*b* transports the developer in the first chamber 141 toward the downstream side (in the direction of arrow g). Some of the developer flowing from the second chamber 142 is further pushed toward the upstream side by the helical blade 144*c*, passes through the most upstream part 141*a* of the first chamber 141, and is discharged from the developer discharge port 148.

Figure 11:
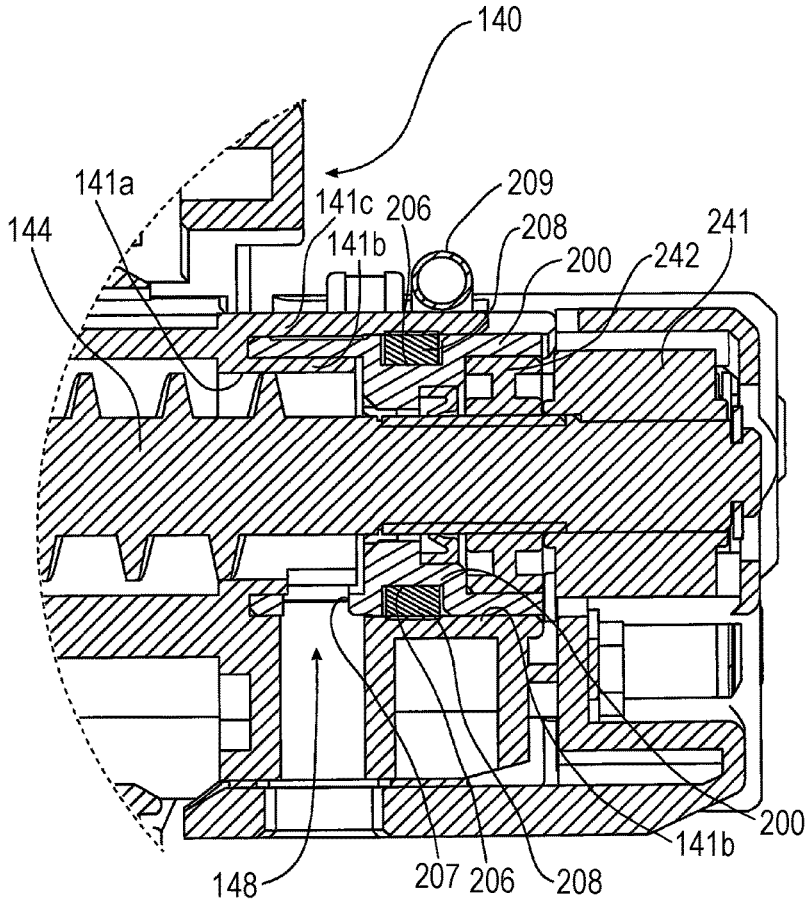
FIG. 11 is an enlargement of a part defined by circle XI illustrated in FIG. 10.

FIG. 11 is an enlargement of a part defined by circle XI illustrated in FIG. 10.

FIG. 11 illustrates a section, including the shutter member 200, taken in the axial direction. The shutter member 200 is held between the inner wall 141*b* and the outer wall 141*c* and has a concave groove 206 provided over the entire circumference of the outer-wall surface thereof. A seal member 208 in the form of an O ring is fitted in the groove 206. The seal member 208 is in contact with the inner surface of the outer wall 141*c*. The seal member 208 is provided for perfectly preventing toner particles of the developer from leaking toward the gear 241 through the gap between the inner surface of the outer wall 141*c* and the shutter member 200.

When the gear 241, which is a helical gear, receives a rotational driving force, a force acting in the direction of the axis of rotation of the supply auger 144 is generated. The direction of rotation of the helical tooth of the gear 241 is set such that the rotation of the gear 241 generates a force acting in the direction opposite to the direction of arrow h. When the gear 241 rotates, the force acting in the axial direction pushes an intermediate member 242, and the intermediate member 242 pushes the shutter member 200. Thus, the shutter member 200 is positioned with respect to the inner wall 141*b* and the outer wall 141*c* in the direction of arrow h.

Figure 12:
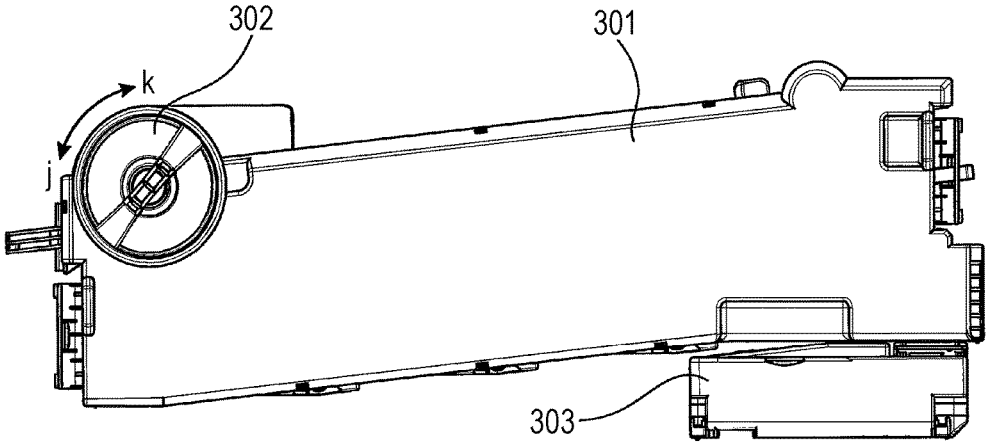
FIG. 12 illustrates a collecting box that appears when a door of a housing of the image forming apparatus illustrated in FIG. 1 is opened.

FIG. 12 illustrates the collecting box 301 that appears when a door (not illustrated) of the housing 140 of the image forming apparatus 1 illustrated in FIG. 1 is opened.

The collecting box 301 is provided in the image forming apparatus 1 in such a manner as to cover the front side of the four image forming units 10Y, 10M, 10C, and 10K, the intermediate transfer belt 30, and the belt cleaner 70 illustrated in FIG. 1. Therefore, the collecting box 301 is detached from the image forming apparatus 1 before the developing unit 14 is detached from the image forming apparatus 1, and the collecting box 301 is attached to the image forming apparatus 1 after the developing unit 14 is attached to the image forming apparatus 1.

The collecting box 301 includes an operation handle 302 and the waste-toner tank 303. The operation handle 302 is an operator that is operated before the developing unit 14 is detached from the image forming apparatus 1 and after the developing unit 14 is attached to the image forming apparatus 1. When the developing unit 14 is in the image forming apparatus 1 and the image forming apparatus 1 is in operation, the operation handle 302 is in an orientation taken after being rotated in a direction of arrow k. FIG. 12 illustrates the operation handle 302 that has been rotated in the direction of arrow k. To detach the developing unit 14 from the image forming apparatus 1, the operation handle 302 is rotated in a direction of arrow j. Thus, the shutter member 200 rotates to be in the "closed orientation" in which the developer discharge port 148 is closed. Conversely, after the developing unit 14 is attached to the image forming apparatus 1, the operation handle 302 is rotated in the direction of arrow k. Thus, the shutter member 200 rotates to be in the "open orientation" in which the developer discharge port 148 is open.

The collecting box 301 is detachably snap-fitted to a body frame (not illustrated) of the image forming apparatus 1.

FIG. 13 illustrates an internal configuration of the collecting box 301.

FIG. 13 illustrates racks 304 and eight pinions 305 that mesh with the racks 304. The eight pinions 305 are arranged in two rows, specifically, upper and lower rows, each including four pinions 305. When the operation handle 302 is rotated in the direction of arrow j, the racks 304 move in a direction of arrow m and the pinions 305 that mesh with the racks 304 each rotate in a direction of arrow p. The upper four pinions 305 are gears for opening and closing shutter members (not illustrated) included in the respective photoconductor cleaners 16 (see FIG. 1). In the image forming apparatus 1 according to the exemplary embodiment, each of the photoconductors 11 and a corresponding one of the photoconductor cleaners 16 and so forth are assembled into a unit, as with the developing unit 14, and such a unit is also attachable to and detachable from the image forming apparatus 1. Therefore, the unit includes a shutter member that openably closes an opening from which waste toner collected by the photoconductor cleaner 16 is discharged.

The lower four pinions 305 are gears for opening and closing the respective shutter members 200 that open and close the developer discharge ports 148 of the respective developing units 14. When the operation handle 302 is in the orientation that is taken after being rotated in the direction of arrow k, the opening-and-closing lever 201 of the shutter member 200 illustrated in FIGS. 6A and 6B is at the position illustrated in FIGS. 6A and 6B that is taken when the opening-and-closing lever 201 is pushed. In this state, the spring member 209 is expanded, and the shutter member 200 is in the open orientation in which the developer discharge port 148 is open. When the operation handle 302 illustrated in FIGS. 12 and 13 is rotated in the direction of arrow j, each of the pinions 305 rotates in the direction of arrow p, a member (not illustrated) that is connected to corresponding one of the lower pinions 305 and pushes down the opening-and-closing lever 201 of the shutter member 200 moves in a direction in which the force of pushing the opening-and-closing lever 201 is reduced, and the urging force of the spring member 209 causes the shutter member 200 to rotate to the closed orientation in which the developer discharge port 148 is closed.

To detach the developing unit 14 from the image forming apparatus 1, the operation lever 149 is operated to be oriented vertically, and the developing unit 14 is pulled out. Conversely, after the developing unit 14 is attached to the image forming apparatus 1, the operation lever 149 is operated to be oriented horizontally. Furthermore, the collecting box 301 (see FIG. 12) is attached to the image forming apparatus 1, and the operation handle 302 is rotated in the direction of arrow k. Then, the racks 304 and the pinions 305 illustrated in FIG. 13 respectively move and rotate in the directions opposite to the directions of arrows m and p illustrated in FIG. 13. Therefore, the opening-and-closing lever 201 of the shutter member 200 illustrated in FIGS. 6A and 6B is pushed down to the position illustrated in FIGS. 6A and 6B. Then, the shutter member 200 is rotated to a position where the shutter opening 207 communicates with the developer discharge port 148, that is, the shutter member 200 is rotated to the open orientation in which the developer discharge port 148 is open.

The developer discharged from the developer discharge port 148 to the outside of the developing unit 14 drops into the waste-toner-transporting tube 306, which is a hollow cylinder. The waste-toner-transporting tube 306 also receives waste toner particles collected by the photoconductor cleaner 16 (see FIG. 1) and waste toner particles collected from the intermediate transfer belt 30 by the belt cleaner 70 (see FIG. 1). The waste toner particles and the developer having flowed into the waste-toner-transporting tube 306 are transported in the direction of arrow i by a transporting member (not illustrated) provided in the waste-toner-transporting tube 306 and are collected into the waste-toner tank 303. When the waste-toner tank 303 becomes full, the waste-toner tank 303 is replaced with an empty waste-toner tank 303 by the user.

While the above exemplary embodiment concerns a case where the opening-and-closing member according to the present invention is the shutter member 200 that opens and closes the developer discharge port 148 by changing its orientation while rotating, the opening-and-closing member according to the present invention may open and close a discharge path by moving to a totally different position. For example, the shutter member 200 having a cylindrical shape may either rotate in the circumferential direction as in the above exemplary embodiment, move in a direction in which the cylindrical body thereof extends, or move in a direction as a combination of both of the foregoing directions. Note that changing the orientation of the opening-and-closing member requires a less space than changing the position of the opening-and-closing member. Such a movement of the opening-and-closing member may also be described as a movement of changing the position (orientation) between a closed position (orientation) where the discharge path is closed and an open position (orientation) where the discharge path is open.

While the above exemplary embodiment employs, as the inner wall and the outer wall according to the present invention, the inner wall 141*b* and the outer wall 141*c* each having a circular sectional shape, the inner wall and the outer wall according to the present invention may each have a flat shape. If the inner wall and the outer wall according to the present invention each have a downward projection and the discharge path has an opening at the position where the projection is provided, powder is collected into the discharge path by its own weight.

While the above description concerns a case where the powder container according to the present invention is applied to a developing unit as an exemplary embodiment, the powder container according to the present invention may be a belt cleaner or a photoconductor cleaner that collects and temporarily stores waste toner particles and discharges the waste toner particles into a collecting box, or may be a toner cartridge.

While the above description concerns a case where the image forming apparatus according to the present invention is applied to a tandem-type color printer as an exemplary embodiment, the image forming apparatus according to the present invention may be, for example, a revolver-type color printer, a monochrome printer, a copier, a facsimile, or a multifunction machine.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder container comprising:

a storing chamber configured to store powder;

a discharge path extending through a wall of the storing chamber, wherein the discharge path is configured to discharge the powder;

an inner wall that forms an inner surface of the wall and has an opening communicating with the discharge path;

an outer wall that forms an outer surface of the wall and has an opening communicating with the discharge path; and an opening-and-closing member provided between the inner wall and the outer wall and that is configured to open and close the discharge path while moving along the inner wall and the outer wall;

wherein the opening-and-closing member has an opening that is positioned between the opening of the inner wall and the opening of the outer wall when the discharge path is opened, and wherein the opening of the inner wall is smaller than the opening of the opening-and-closing member, the opening of the outer wall is larger than the opening of the opening-and-closing member, and, in a state where the discharge path is open, edges of the openings are shifted from one another when seen in a direction in which the powder passes through the discharge path.

2. The powder container according to claim 1, further comprising a blocking member configured to block entry of the powder into a gap between the opening-and-closing member and the inner wall.

3. A developing unit comprising:

a storing chamber configured to store powder developer with which a latent image is developed;

a discharge path extending through a wall of the storing chamber, wherein the discharge path is configured to discharge the developer;

an inner wall that forms an inner surface of the wall and has an opening communicating with the discharge path;

an outer wall that forms an outer surface of the wall and has an opening communicating with the discharge path; and an opening-and-closing member provided between the inner wall and the outer wall and that is configured to open and close the discharge path while moving along the inner wall and the outer wall;

wherein the opening-and-closing member has an opening that is positioned between the opening of the inner wall and the opening of the outer wall when the discharge path is opened, and wherein the opening of the inner wall is smaller than the opening of the opening-and-closing member, the opening of the outer wall is larger than the opening of the opening-and-closing member, and, in a state where the discharge path is open, edges of the openings are shifted from one another when seen in a direction in which the powder passes through the discharge path.

4. An image forming apparatus comprising:

an image carrier configured to carry an image;

a latent-image-forming unit configured to form a latent image on the image carrier;

a developing unit configured to develop the latent image with powder developer; and a transfer unit configured to transfer the image developed by the developing unit from the image carrier to a recording material, wherein the developing unit includes:

a storing chamber configured to store the developer;

a discharge path extending through a wall of the storing chamber, wherein the discharge path is configured to discharge the developer;

an inner wall that forms an inner surface of the wall and has an opening communicating with the discharge path;

an outer wall that forms an outer surface of the wall and has an opening communicating with the discharge path; and an opening-and-closing member provided between the inner wall and the outer wall and that is configured to open and close the discharge path while moving along the inner wall and the outer wall;

wherein the opening-and-closing member has an opening that is positioned between the opening of the inner wall and the opening of the outer wall when the discharge path is opened, and wherein the opening of the inner wall is smaller than the opening of the opening-and-closing member, the opening of the outer wall is larger than the opening of the opening-and-closing member, and, in a state where the discharge path is open, edges of the openings are shifted from one another when seen in a direction in which the powder passes through the discharge path.

* * * * *